United States Patent [19]

Rann

[11] 4,392,402

[45] Jul. 12, 1983

[54] APPARATUS FOR SEVERING RUNNING PAPER WEBS OR THE LIKE

[75] Inventor: Harald Rann, Norderstedt, Fed. Rep. of Germany

[73] Assignee: E.C.H. Will (GmbH & Co.), Hamburg, Fed. Rep. of Germany

[21] Appl. No.: 333,104

[22] Filed: Dec. 21, 1981

Related U.S. Application Data

[63] Continuation of Ser. No. 144,029, Apr. 28, 1980, abandoned.

[30] Foreign Application Priority Data

May 31, 1979 [DE] Fed. Rep. of Germany ..... 2922164

[51] Int. Cl.[3] ..... B26D 1/62

[52] U.S. Cl. ..... 83/345; 83/674; 83/699; 407/44; 241/294

[58] Field of Search ..... 83/342, 343, 344, 345, 83/346, 347, 348, 349, 507, 673, 674, 698, 699, 700; 144/221, 230; 241/294; 407/44, 45, 77, 90, 109

[56] References Cited

U.S. PATENT DOCUMENTS

| | | | |
|---|---|---|---|
| 2,221,022 | 11/1940 | Ellis | 83/344 X |
| 2,751,006 | 6/1956 | Lane | 83/698 X |
| 3,032,152 | 5/1962 | Titsler | 83/698 X |
| 3,251,256 | 5/1966 | McGrath | 83/700 X |
| 3,709,077 | 1/1973 | Trogan et al. | 83/699 X |
| 3,822,625 | 7/1974 | Obenshain | 83/699 X |
| 3,935,774 | 2/1976 | Craddy | 83/699 X |
| 3,989,077 | 11/1976 | Humbert | 83/698 X |
| 4,187,753 | 2/1980 | Walde | 83/698 X |

FOREIGN PATENT DOCUMENTS 2606036 8/1977 Fed. Rep. of Germany ..... 83/345

*Primary Examiner*—James L. Jones, Jr.
*Assistant Examiner*—Robert P. Olszewski
*Attorney, Agent, or Firm*—Kontler, Grimes & Battersby

[57] ABSTRACT

A transverse cutter for a running web of paper or the like has two rotary drum-shaped holders disposed opposite each other at the opposite sides of the path for the web. Each holder carries at least one knife with an elongated cutting edge extending transversely of the path of movement of the web, and each knife of one holder cooperates with a knife of the other holder to sever the web once during each revolution of the holders. One of the knives is adjustable with reference to the respective holder so that its cutting edge can be shifted relative to the cooperating cutting edge of the other knife. The adjusting mechanism for the adjustable knife includes a row of closely adjacent wedge-like retainers which are recessed into the peripheral surface of the respective holder and are movable radially of such holder by threaded fasteners which can move the associated retainers radially inwardly against the opposition of dished springs in the respective holder. Each retainer has a projection which engages one side of the adjustable knife midway between the cutting edge and the innermost portion of such side. The other side of the adjustable knife bears against a second row of wedge-like retainers which are recessed into the respective holder and have projections bearing against the innermost portion of the other side of the adjustable knife. Such mounting allows for at least some elastic flexing of the adjustable knife.

12 Claims, 3 Drawing Figures

APPARATUS FOR SEVERING RUNNING PAPER WEBS OR THE LIKE

This application is a continuation, of application Ser. No. 144,029, filed Apr. 28, 1980, now abandoned.

BACKGROUND OF THE INVENTION

The present invention relates to apparatus for severing running webs or strips which consist of paper, cardboard, plastic foil or the like, and more particularly to improvements in so-called transverse cutters wherein two rotary holders which are disposed at the opposite sides of the path of movement of a running web and opposite each other are provided with knives which cooperate to sever the web in a plane extending transversely of the direction of lengthwise movement of the web.

In certain presently known severing apparatus of the above outlined character, the rotary holders carry spiral-shaped knives in order to ensure that the severing action will resemble that of the blades of shears. Such apparatus present problems in connection with adjustment of the knives in order to compensate for wear upon their cutting edges. Adjustment of the knives is necessary because the cutting edges must move past each other with a minimum of clearance; otherwise, the severing action of the apparatus is unsatisfactory for a number of purposes, e.g., in connection with the making of paper sheets which are thereupon stacked preparatory to conversion into steno pads, exercise books and like stationary products.

OBJECTS AND SUMMARY OF THE INVENTION

An object of the invention is to provide a severing apparatus for running webs or strips of paper or the like wherein at least one of each pair of cooperating knives can be readily adjusted relative to the other knife in a simple and time-saving manner.

Another object of the invention is to provide an apparatus of the just outlined character which is constructed and assembled in such a way that the adjustments of one knife with respect to the other knife and/or vice versa can be carried out by unskilled persons and that the adjustments can be effected with a heretofore unmatched degree of accuracy and reproducibility.

A further object of the invention is to provide the severing apparatus with novel and improved means for releasably fixing one or more knives in any one of a practically infinite number of different positions with reference to its or their holder and/or the holder for the cooperating complementary knife.

An additional object of the invention is to provide a novel and improved transverse cutter for running webs or strips of paper or the like which can be readily installed in existing paper processing machines as a superior substitute for heretofore known cutters.

Another object of the invention is to provide a severing apparatus wherein the knives are adequately supported regardless of whether such knives are mounted in holders of minimal, medium or considerable axial length, i.e., regardless of the length of cutting edges.

A further object of the invention is to provide a cutting or severing apparatus of the above outlined character wherein the adjustments of one knife with reference to the complementary knife can be carried out by resorting to simple and readily available tools.

The invention is embodied in an apparatus for subdividing at least one running web or strip of paper or the like into discrete sheets by severing the web or strip during lengthwise transport along a predetermined path. The apparatus comprises a rotary holder (e.g., a drum) disposed at one side of the aforementioned path, a knife having an elongated cutting edge extending transversely of the path and arranged to sever the web or strip once during each revolution of the holder, and means for adjustably securing the knife to the holder. The securing means includes a row of preferably closely adjacent neighboring retainers (each of which may resemble or constitute a wedge) at one side of the knife (e.g., at the front side, as considered in the direction of rotation of the holder), and discrete fasteners or other suitable means for moving the retainers relative to the knife to thereby change the position of the cutting edge with respect to the holder. The row of retainers preferably extends in substantial parallelism with the axis of the holder, and the neighboring retainers of the row are closely adjacent to but preferably slightly spaced apart from each other.

The apparatus preferably further comprises a second rotary holder located at the other side of the path for the web or strip opposite the first mentioned holder, and a second knife mounted in the second holder and having a cutting edge which cooperates with the cutting edge of the first mentioned knife (e.g., in a manner as known from the cutting edges of shear blades) to sever the web or strip in the path once during each revolution of the respective holders. Thus, the cutting edges approach each other at intervals whose length is determined by the diameters of the holders and the speed of lengthwise movement of the web or strip (such speed preferably matches the speed of the cutting edges). The knife of the second holder may but need not be adjustable with reference to its holder, i.e., with reference to the first mentioned knife.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
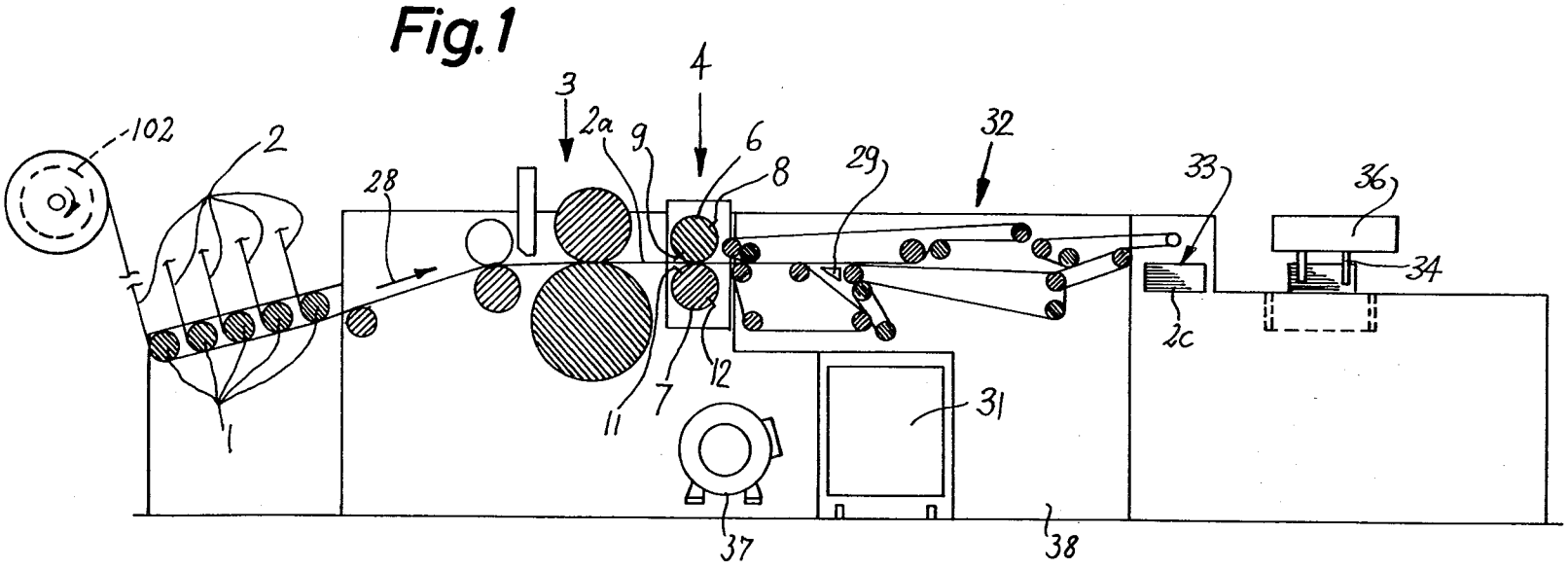
FIG. 1 is a schematic partly elevational and partly longitudinal vertical sectional view of a paper processing machine embodying a transverse cutting web severing apparatus which is constructed and assembled in accordance with the present invention.

Referring first to FIG. 1, there is shown a machine which processes several webs or strips 2 of paper, cardboard, metallic foil, plastic foil or the like. The webs 2 are assumed to consist of paper and are drawn off discrete reels one of which is shown at 102. Each web 2 is deflected by a separate guide roll 1 so that the webs overlie each other. The thus overlapped webs 2 pass through a first severing apparatus 3 which subdivides each web into two or more narrower webs or strips 2*a* by splitting the webs in one or more planes which are parallel to the direction (arrow 28) of lengthwise movement of the webs. The first severing apparatus 3 is followed by a second severing apparatus 4 which is constructed and assembled in accordance with the present invention.

The sheets 2*c* which advance beyond the nip of two rotary drum-shaped knife holders 6, 7 of the severing apparatus 4 move into the range of a wedge-like deflector 29 which can be actuated to direct defective sheets into a receptacle 31 and to permit satisfactory sheets 2*c* to advance into the range of a conveyor system 32. The member 29 further serves to deflect sheets 2*c* which are to be examined for quality and/or other characteristics, i.e., to remove samples from the customary path of the sheets. The conveyor system 32 forms no part of the invention; its purpose is to cause tfhe sheets 2*c* to overlap each other and to accumulate in a collecting receptacle 33. The thus obtained piles or stacks of superimposed sheets 2*c* are transferred into the range of fingers 34 of a shifting device 36 which transports successive stacks at right angles to the plane of FIG. 1, e.g., into the range of a device which binds the stacks to convert predetermined numbers of sheets into steno pads, exercise books or like final products. The reference character 37 denotes a prime mover which can impart motion to some or all mobile components of the paper processing machine. The just described parts of the machine are installed in a frame 38 which further supports a control panel and other customary components of the paper processing machine.

Figure 2:
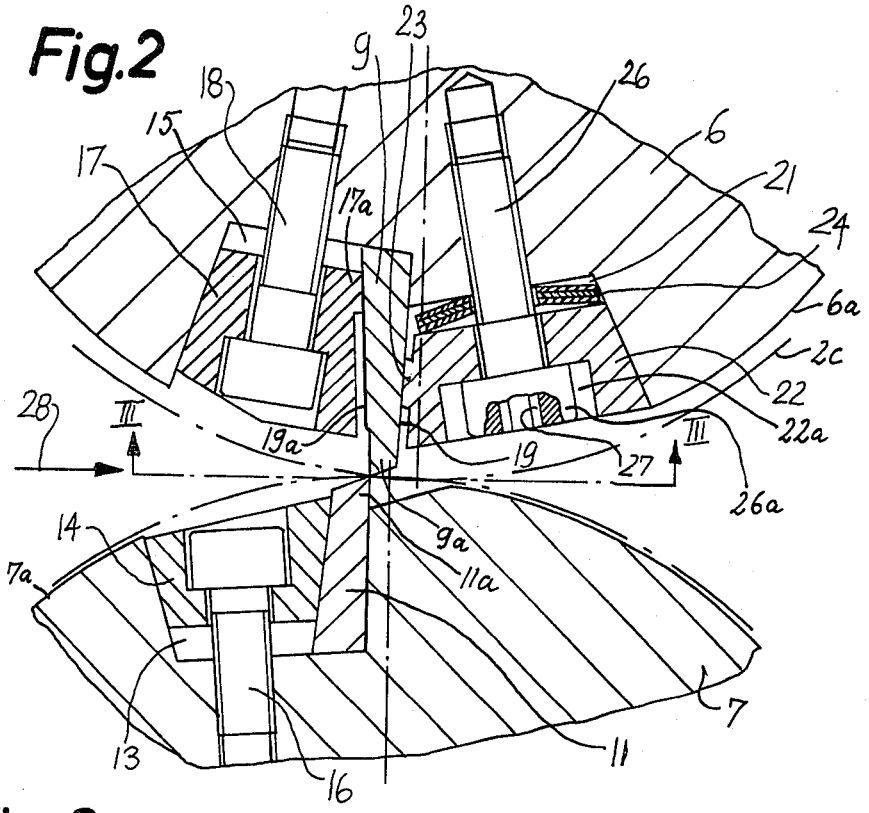
FIG. 2 is a greatly enlarged fragmentary transverse sectional view of the two rotary knife holders in the severing apparatus of the machine shown in FIG. 1.
Figure 3:
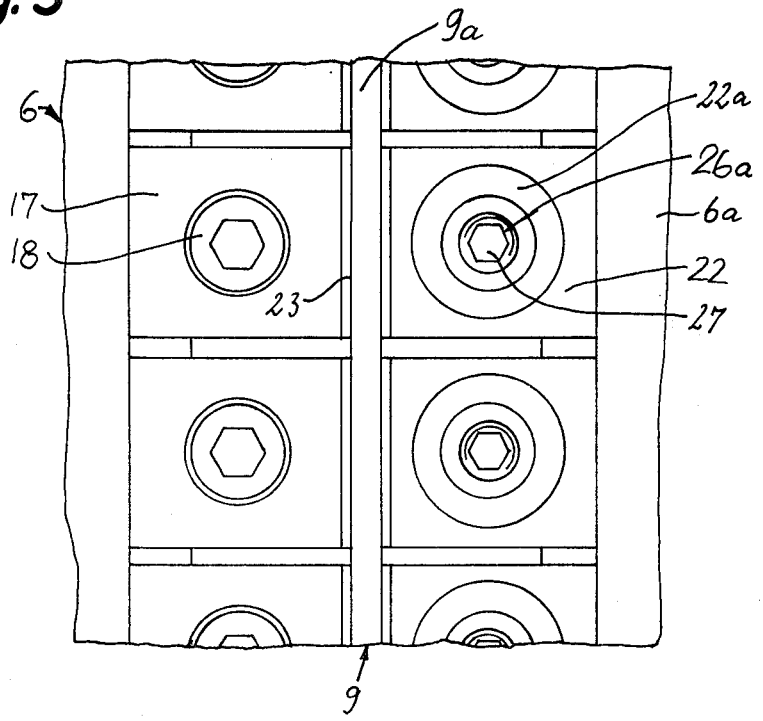
FIG. 3 is an end elevational view as seen in the direction of arrows from the line III—III of FIG. 2.

The details of the severing apparatus 4 are shown in FIGS. 2 and 3. This apparatus comprises the aforementioned rotary drum-shaped knife holders 6 and 7 which are journalled in the frame 38, one above the other, so that their axes are parallel to each other and extend at right angles to the direction which is indicated by the arrow 28. The upper holder 6 carries two knives 8 and 9 which are disposed mirror symmetrically (diametrically) opposite each other and whose cutting edges extend in parallelism with the axis of the holder 6. The lower holder 7 carries two elongated knive 11 and 12 which are mirror symmetrical to each other and extend across the entire path of movement of webs or strips 2*a*. The cutting edge of the knife 8 cooperates with the cutting edge of the knife 12 to sever the strips 2*a* once during each revolution of the holders 6, 7, and the cutting edge 9*a* of the knife 9 cooperates with the cutting edge 11*a* of the knife 11 to sever the strips 2*a* once during each revolution of the two holders. It is clear that each holder can carry a single knife or three or more knives, depending on the desired length of discrete sheets 2*c* and on the speed of forward movement of the strips 2*a*. Such speed matches the peripheral speed of the holders 6 and 7, i.e., the speed of cutting edges of the knives 8, 9, 11 and 12, at least while the knives perform a cutting or severing operation.

FIG. 2 shows the cutting edges 9*a*, 11*a* of the knives 9, 11 in the process of severing the strips 2*a* (not specifically shown) which advance in the direction of the arrow 28 toward and through the clearance between the rotary holders 6 and 7. The main portion of the knife 11 extends into a recess 13 which is machined into the peripheral surface 7*a* and extends along the full axial length of the holder 7 (at the very least, the length of the recess 13 matches the width of the strips 2*a*). The thickness of the knife 9 increases in a direction toward the axis of the holder 7, one side of this knife bears directly against an internal surface of the holder 7, and the other side of the knife 11 is engaged by the front surface of a wedge-like retaining element 14 which is inserted into the recess 13 and is separably secured to the holder 7 by a row of threaded fasteners 16. The element 14 may be assembled of two or more discrete sections or retainers which are disposed in a row extending in parallelism with the axis of the holder 7. It will be noted that the left-hand surface of the element 14 bears against the adjacent surface in the recess 13 of the holder 7. The wedge-like configuration of the element 14 and the wedge-like configuration of the major portion of the knife 11 ensure that the latter is held against any movement when the fasteners 16 are tightened.

The knife 9 is adjustably mounted in the upper holder 6 between two rows of wedge-like retainers 17 and 22. The manner of mounting the knife 9 is such that its outer portion can be flexed, within the elastic limits of its material, in order to enhance the cutting or severing action of the cutting edges 9*a* and 11*a*. To this end, the left-hand (rear) side 19*a* of the knife 9 is engaged by the retainers 17 only in the region of its inner end portion, namely, in the deepmost or close to the deepmost portion of an elongated recess 15 in the peripheral surface 6*a* of the holder 6. The retainers 17 have aligned projections 17*a* which bear against the respective side 19*a* of the inner or innermost portion of the knife 9 (see FIG. 2). Each retainer 17 is separably attached to the holder 6 by at least one threaded fastener 18. It will be noted that the retainers 17 are fully confined in the recess 15, the same as the corresponding fasteners 18. Only the cutting edge 9*a* of the knife 9 extends beyond the peripheral surface 6*a* of the holder 6.

The other (front) side 19 of the knife 9 is engaged by the aligned projections or protuberances 23 forming part of the wedge-like retainers 22 which are inserted into a wedge-like recess 21 in the peripheral surface 6*a* of the rotary holder 6. In the embodiment of FIGS. 2 and 3, the recess 21 is located ahead of the recess 15, as considered in the direction of (counterclockwise) rotation of the holder 6. The holder 7 rotates clockwise, as viewed in FIG. 2. The retainers 22 are held in their recess 21 by a series of bolts or analogous threaded fasteners 26, at least one for each retainer 22, which mate with the holder 6. The heads 26*a* of these fasteners extend into recesses 22*a* in the outer sides of the respective retainers 22 and have hexagonal blind bores or sockets 27 for reception of the working end of a suitable tool (not shown) which is resorted to by an attendant to change the position of the cutting edge 9*a* with reference to the holder 6 and hence with reference to the holder 7 and cutting edge 11*a* of the associated knife 11. The deepmost portion of the recess 21 accommodates sets of dished springs 24 or analogous resilient means serving to yieldably oppose movement of the retainers 22 radially inwardly toward the axis of the holder 6. The springs 24 (or analogous resilient means) ensure that the projections 23 engage the surface 19 without any play, i.e., without any wobbling of the knife 9 in the space between the recesses 15 and 21. These recesses together constitute a composite recess for the means 17, 18, 22, 26 which adjustably secure the knife 9 to the holder 6.

FIG. 3 shows that the neighboring retainers 17 and 22 are respectively closely adjacent to but do not touch each other. Such mounting of the two rows of retainers is desirable in order to compensate for eventual expansion or contraction due to changing temperatures. It will be noted that the major part of the knife 11 is or resembles a wedge which tapers in a direction radially of and away from the axis of the holder 6. The retainers 17 and 22 are wedges which taper in the opposite direction, i.e., toward the axis of the holder 6. This guarantees that the knife 9 between the two rows of retainers (17 and 22) cannot fly away under the action of centrifugal force when the prime mover 37 drives the holder 6. The projections 23 engage the respective side 19 of the knife 9 substantially midway between the row of projections 17*a* bearing against the innermost portion of the rear side 19*a* of the knife 9 and the cutting edge 9*a*.

If the wear upon the cutting edge 9*a* and/or 11*a* is sufficiently pronounced, the attendant or attendants rotate the fasteners 26 in a direction to move the respective retainers 22 deeper into the recess 21 of the holder 6, i.e., to stress the dished springs 24. This results in flexing of a substantial portion of the knife 9 in a direction to the left, as viewed in FIG. 2, i.e., the cutting edge 9*a* moves nearer to the cutting edge 11*a*. The adjustment may be such that the cutting edge 9*a* remains or becomes straight, or that the cutting edge 9*a* assumes a shape which deviates, at least in part, from a straight line.

The fasteners 16 and 18 are preferably (but need not be) identical with the fasteners 26, i.e., the heads of the fasteners 16 and/or 18 can also have hexagonal or otherwise configurated polygonal sockets for insertion of working ends of suitable tools which enable an attendant to remove or tighten the respective fasteners.

The manner in which the knife 12 is mounted in the holder 7 is preferably the same as the mounting of the knife 11, and the manner of adjustably mounting the knife 8 in the holder 6 is preferably identical with the mounting of the knife 9. However, it will be readily appreciated that each and every knife can be mounted in the same way as the knife 9, that the knives 8 and 11 can be adjustably mounted in the respective holders 6 and 7, that the knives 9 and 12 can be adjustably mounted, or that the knives 11 and 12 can be adjustably mounted in the respective holders.

An important advantage of the improved severing apparatus 4 is that the retainers 17 and/or 22 are not in mere point contact with the respective knife 9; in fact, it can be said that the contact between each of these retainers and the knife 9 is more than a linear contact in spite of the fact that the knife 9 can be flexed within elastic limits to enhance the severing action because the cutting edges 9*a* and 11*a* cooperate not unlike the cutting edges on shear blades. The operators are free to adjust the knife 9 in such a way that the cutting edge 9*a* is or remains straight or resembles a portion of a spiral. As a rule, one will attempt to avoid an undulate shape of the cutting edge 9*a* because such undulate shape is characteristic of cutting edges which are in mere point contact with their retainer or retainers. Satisfactory adjustment of the knife 9*a* is desirable and advantageous for several reasons, i.e., not only because such adjustment warrants the making of clean cuts. Thus, a properly adjusted cutting edge is subjected to less pronounced wear (unnecessary wear is avoided) and the wear is more uniform to ensure longer useful life of the knife.

Another advantage of the improved severing apparatus 4 which is shown in FIGS. 2 and 3 is that the parts which secure the knife 9 as well as the knife 11 to the respective holders can be readily configurated in such a way as to offer negligible resistance to rotation of the respective holders. Thus, the wedge-like retainers and their fasteners can be fully concealed in the respective holders so that they do not cause turbulence when the holders rotate, even if the prime mover 37 drives these holders at an elevated speed. The outer portions of the retainers can be readily configurated in such a way that they exhibit a curvature which matches that of the peripheral surfaces 6*a* and 7*a*. Generation of eddy currents or like turbulence at the severing station (in and close to the nip of the drum-shaped rotary holders 6 and 7) is undesirable for several reasons. Thus, such turbulence could result in generation of undesirable noise and it could cause fluttering of sheets 2*c* on their way toward and beyond the deflector 29.

The provision of springs 24 enables the attendants to effect highly accurate adjustments of the cutting edge 9*a* as well as to prevent wobbling of the knife 9, even after repeated adjustments.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. In an apparatus for subdividing at least one running paper web or the like into discrete sheets by severing the web during lengthwise transport along a predetermined path, the combination of a rotary holder disposed at one side of said path; a flexible knife having an inner portion and an elongated cutting edge remote from said inner portion, extending transversely of said path and arranged to sever the web once during each revolution of said holder; and means for adjustably securing said knife to said holder, including first retainer means recessed into said holder at one side of said knife and arranged to urge said inner portion of the knife against said holder, and second retainer means comprising a row of discrete retainers disposed at the other side of said knife, said row extending in substantial parallelism with the axis of said holder and each of said retainers being at least in linear contact with said other side of said knife, as considered in the axial direction of said holder, the neighboring retainers of said row being closely adjacent to each other and engaging said other side of the knife intermediate said inner portion and said cutting edge, said securing means further including means for moving said retainers relative to said knife and substantially radially of said holder to thereby move the loci of engagement between said retainers and said other side of the knife substantially radially of said holder with attendant flexing of the knife and resulting change in the position of said cutting edge with respect to said holder.

2. The combination of claim 1, further comprising a second rotary holder located at the other side of said path opposite said first mentioned holder, and a second knife mounted in said second holder and having a second cutting edge cooperating with said first mentioned cutting edge to sever the web in said path once during each revolution of the respective holders.

3. The combination of claim 1, wherein said holder has a recess for said retainers and said inner portion of said knife extends inwardly and beyond said recess, as considered in the radial direction of said holder.

4. The combination of claim 3, wherein said moving means includes fasteners actuatable to move each retainer of said row independently of the other retainers.

5. The combination of claim 3, wherein said other side of said knife has an end portion remote from said cutting edge and forming part of said inner portion, said retainers including projections engaging said other side of said knife intermediate said end portion and said cutting edge.

6. The combination of claim 5, wherein each of said projections extends substantially along the full width of the respective retainers, as considered in the axial direction of said holder.

7. The combination of claim 3, wherein each of said retainers is a wedge and said recess has a wedge-like portion for said retainers, and further comprising means for yieldably opposing the movement of said retainers toward the axis of said holder.

8. The combination of claim 7, wherein said opposing means includes resilient means, said portion of said recess having a deepmost zone for said resilient means.

9. The combination of claim 7, wherein said opposing means includes dished springs.

10. The combination of claim 1, wherein said moving means includes threaded fasteners meshing with said holder.

11. The combination of claim 10, wherein said fasteners have exposed portions which are accessible at the periphery of said holder.

12. The combination of claim 11, wherein said exposed portions have sockets of polygonal outline for reception of tools which serve to rotate said fasteners with respect to said holder.

* * * * *